US006811425B1

(12) United States Patent
Chiang

(10) Patent No.: US 6,811,425 B1
(45) Date of Patent: Nov. 2, 2004

(54) CONTROLLER MODULE RESPONSIVE TO INPUT SIGNALS FOR CONTROLLING AN ELECTRICAL APPLIANCE

(75) Inventor: Ching-Chung Chiang, Taichung Hsien (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 10/669,602

(22) Filed: Sep. 25, 2003

(51) Int. Cl.[7] ..... H01R 13/62
(52) U.S. Cl. ..... 439/372; 439/912
(58) Field of Search ..... 439/709, 912, 439/372, 718, 922, 715, 716, 412, 411, 44, 413, 417

(56) References Cited

U.S. PATENT DOCUMENTS 1,023,326 A * 4/1912 Murray ..... 337/188
2,872,506 A * 2/1959 Flubacker ..... 174/153 R
5,836,791 A * 11/1998 Waas et al. ..... 439/709
6,033,268 A * 3/2000 Piper et al. ..... 439/715
6,222,717 B1 * 4/2001 Waas et al. ..... 361/119
6,224,418 B1 * 5/2001 Miura et al. ..... 439/495
6,338,648 B1 * 1/2002 Miura et al. ..... 439/495
6,736,683 B2 * 5/2004 Brand et al. ..... 439/828

* cited by examiner

*Primary Examiner*—Ross Gushi
*Assistant Examiner*—Phuongchi Nguyen
(74) *Attorney, Agent, or Firm*—Nixon & Vanderhye P.C.

(57) ABSTRACT

In a controller module, a connecting seat of a circuit unit is disposed in a hollow case, is exposed from an open end of the case, is coupled electrically to a control circuit, and is formed with first conductive contacts. A terminal block, mounted detachably in a cover member, has a mounting side provided with second conductive contacts that are connected electrically, respectively and removably to the first conductive contacts, an input side opposite to the mounting side and formed with input insertion holes for insertion of external terminals, and a top side formed with probe insertion holes for insertion of test probes. A positioning member is mounted pivotally on the cover member for positioning the terminal block on the connecting seat.

3 Claims, 7 Drawing Sheets

CONTROLLER MODULE RESPONSIVE TO INPUT SIGNALS FOR CONTROLLING AN ELECTRICAL APPLIANCE

BACKGROUND OF THE INVENTION

1. Field of the Invention

The invention relates to a controller module, more particularly to a controller module responsive to input signals for controlling an electrical appliance.

2. Description of the Related Art

FIGS. 1 and 2 illustrate a conventional controller module 1 responsive to input signals for controlling an electrical appliance (not shown). The conventional controller module 1 includes a circuit unit 13 disposed in a hollow case 11, a cover member 12, two terminal blocks 14, and two positioning members 15. The circuit unit 13 includes two connecting seats 131 (only one is shown) that are exposed from an open end of the case 11. The cover member 12 is mounted detachably on the open end of the case 11, and has opposite side walls 123 and a bottom wall 124 in each of opposite lateral sides thereof so as to cooperate with the corresponding connecting seat 131 to confine a block receiving space. Each terminal block 14 is mounted detachably in a respective block receiving space through an opening 121 confined by the side walls 123 and is connected electrically to a respective connecting seat 131. Each terminal block 14 has a mounting side connected electrically to the corresponding connecting seat 131, a top side formed with a set of probe insertion holes 141 for insertion of a set of test probes 2 (only one is shown in FIG. 2), and an input side opposite to the mounting side and formed with a set of input insertion holes 142 for insertion of a set of external terminals (not shown). Each positioning member 15 is mounted pivotally on a corresponding lateral side of the cover member 12, and is disposed at the opening 121 in the corresponding lateral side of the cover member 12. Each positioning member 15 is formed with opposite pivot posts 151 that are pivotally retained in pivot holes 122 formed in the side walls 123 of the corresponding lateral side of the cover member 12, respectively, and a plurality of positioning posts 152 received in a plurality of positioning holes 143 formed in the input side of the corresponding terminal block 14. By virtue of the positioning member 15, the terminal blocks 14 can be positioned on the connecting seats 131.

In use, one of the terminal blocks 14 can be used to connect the circuit unit 13 to an electrical appliance, whereas the other of the terminal blocks 14 can be used to connect the circuit unit 13 to external devices, such as sensors and the like. Accordingly, the circuit unit 13 can control the electrical appliance based on input signals received from the external devices.

By changing the circuit unit 13, the controller module 1 can be used to control different electrical appliances according to different operating requirements.

Moreover, by virtue of the probe insertion holes 141 in the terminal blocks 14, testing of the circuit unit 31 can be conducted through the test probes 2 without the need to remove the circuit unit 13 from the case 11.

It is noted that the positioning members 15 must be pivoted upwardly so as to expose the probe insertion holes 141 for insertion of the test probes 2 during testing, thereby resulting in inconvenience.

SUMMARY OF THE INVENTION

Therefore, the object of the present invention is to provide a controller module that can eliminate the aforesaid drawback of the prior art.

According to the present invention, there is provided a controller module responsive to input signals for controlling an electrical appliance. The controller module comprises:

- a circuit unit including a control circuit adapted to be connected electrically to the electrical appliance, and a connecting seat coupled electrically to the control circuit and formed with a set of first conductive contacts;
- a hollow case having an open end, the circuit unit being disposed in the case such that the connecting seat of the circuit unit is exposed from the open end of the case;
- a cover member mounted detachably on the open end of the case, the cover member being formed with first and second openings, the cover member having opposite side walls, each of which has a pivot edge formed with a pivot groove, and a vertical edge, the pivot edges of the side walls confining the first opening, the vertical edges of the side walls confining the second opening, the cover member further having a bottom wall extending between the side walls and spaced apart from the pivot edges of the side walls, the connecting seat of the circuit unit being spaced apart from the vertical edges of the side walls by the bottom wall, the side walls, the bottom wall and the connecting seat cooperating to confine a block receiving space;
- a terminal block mounted detachably in the block receiving space through the second opening in the cover member such that the terminal block is accessible through the second opening, the terminal block having a mounting side provided with a set of second conductive contacts that are connected electrically, respectively and removably to the first conductive contacts, an input side opposite to the mounting side and formed with a set of input insertion holes adapted for insertion of a set of external terminals so as to permit connection of the external terminals to the first conductive contacts through the second conductive contacts, respectively, and a top side formed with a set of probe insertion holes adapted for insertion of a set of test probes so as to permit connection of the test probes to the first conductive contacts through the second conductive contacts, respectively; and
- a positioning member mounted pivotally on the cover member and disposed at the first opening in the cover member for positioning the terminal block on the connecting seat, the positioning member having a first plate body disposed above the top side of the terminal block and formed with a set of positioning holes that are registered with the probe insertion holes in the top side of the terminal block, respectively, and a second plate body connected to the first plate body, extending into the second opening in the cover member, and engaging the input side of the terminal block without covering the input insertion holes, the first plate body being formed with opposite pivot posts that are pivotally retained in the pivot grooves, respectively.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
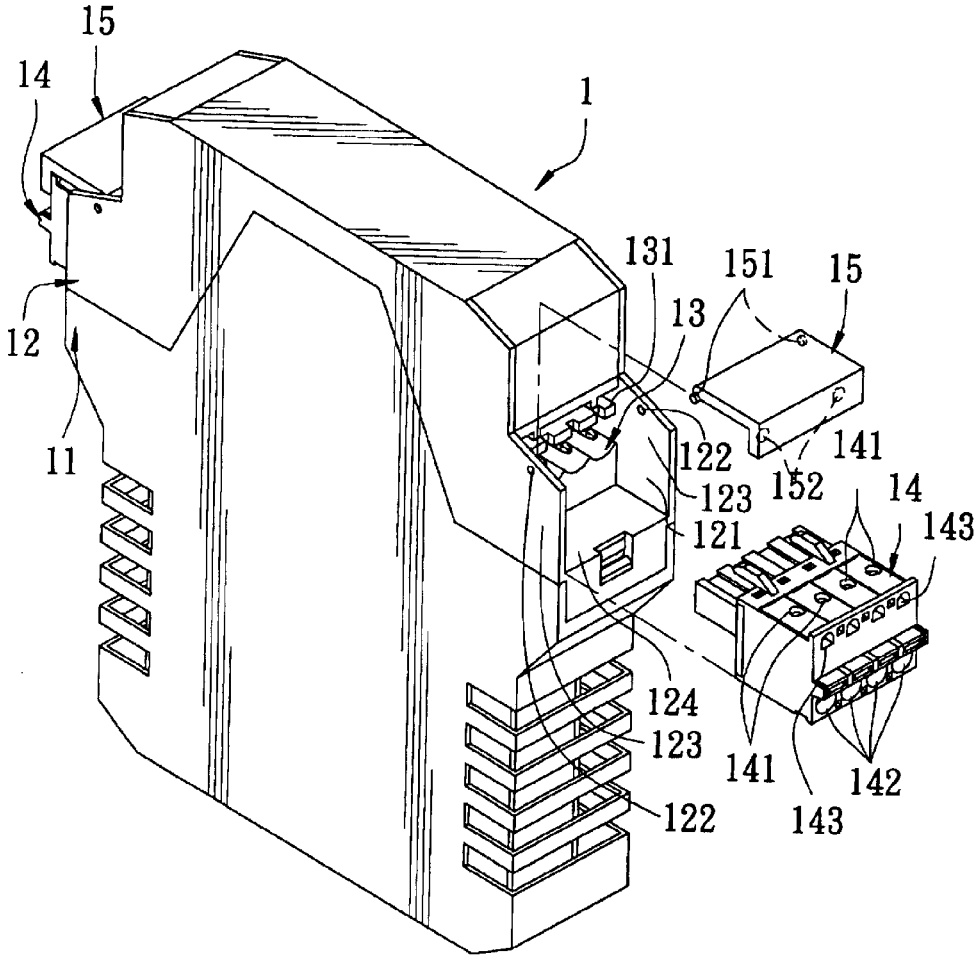
FIG. 1 PRIOR ART
FIG. 1 is a partly exploded perspective view of a conventional controller module.
Figure 2:
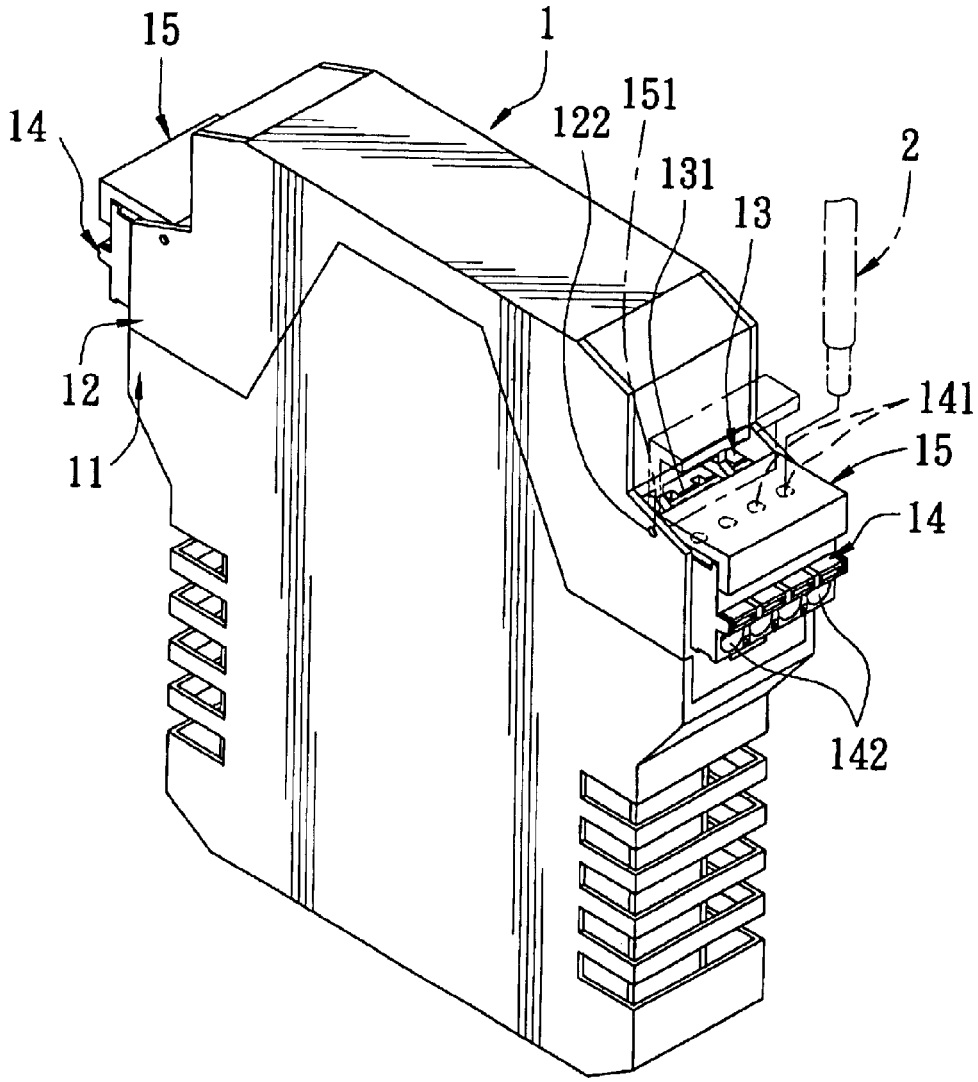
FIG. 2 PRIOR ART
FIG. 2 is an assembled perspective view of the conventional controller module.

Before the present invention is described in greater detail, it should be noted that like elements are denoted by the same reference numerals throughout the disclosure.

Figure 3:
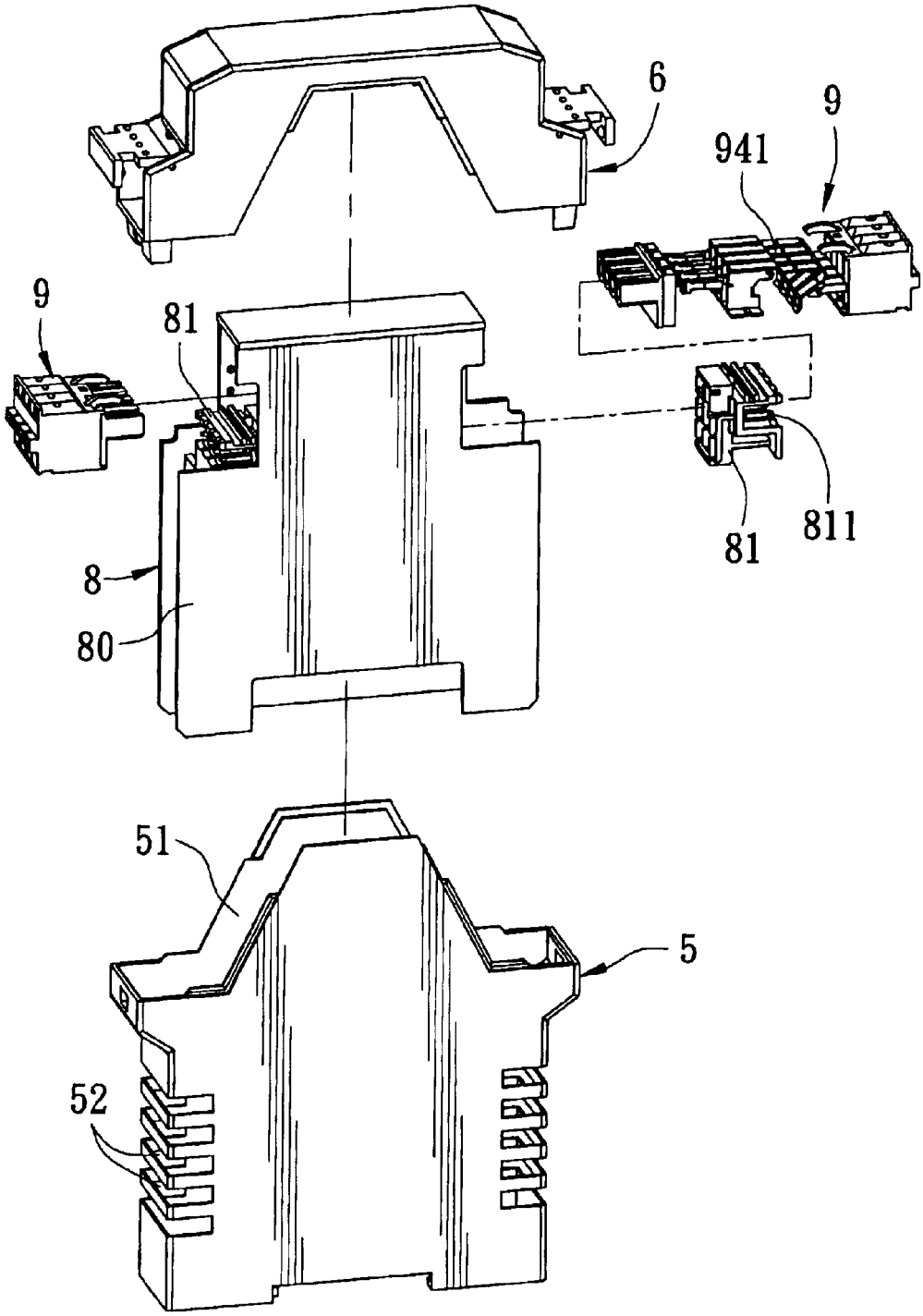
FIG. 3 is an exploded perspective view showing the first preferred embodiment of a controller module according to the present invention.
Figure 4:
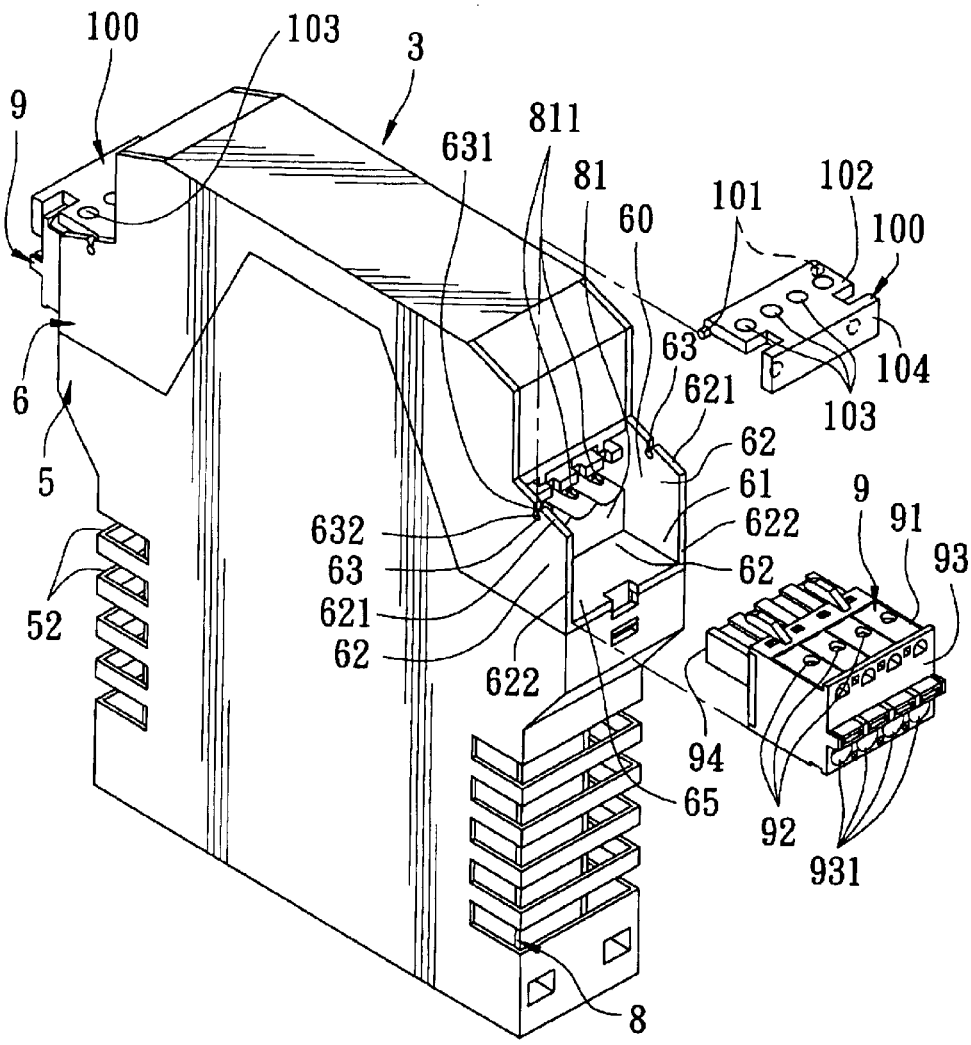
FIG. 4 is a partly exploded perspective view of the first preferred embodiment.
Figure 5:
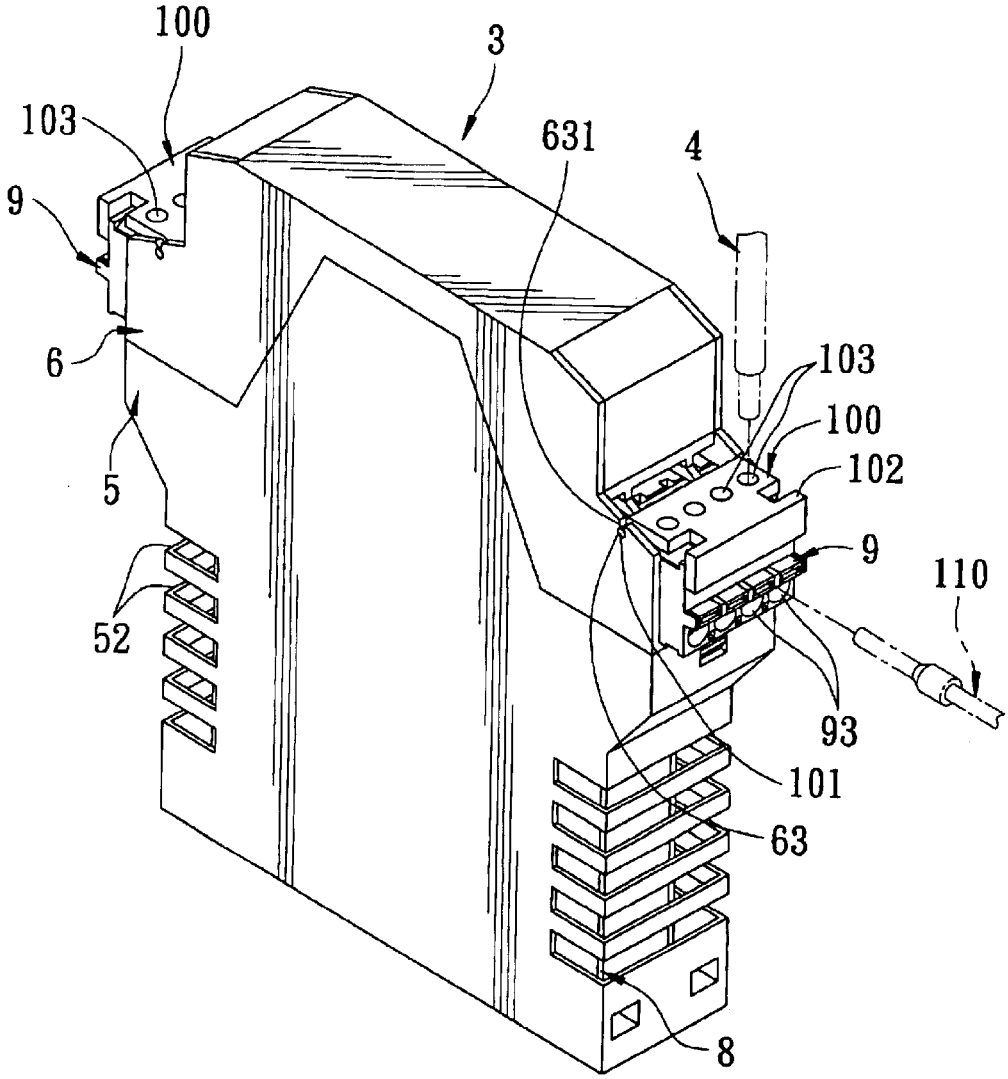
FIG. 5 is an assembled perspective view of the first preferred embodiment.

Referring to FIGS. 3 to 5, the first preferred embodiment of a controller module 3 according to the present invention is shown to be responsive to input signals for controlling an electrical appliance (not shown). The controller module 3 includes a circuit unit 8, a hollow case 5, a cover member 6, two terminal blocks 9, and two positioning members 100.

The circuit unit 8 includes a control circuit 80 adapted to be connected electrically to the electrical appliance, and two connecting seats 81 coupled electrically to the control circuit 80. Each connecting seat 81 is formed with a set of first conductive contacts 811, as shown in FIG. 3.

The case 5 has an open end 51. The circuit unit 8 is disposed in the case 5 such that the connecting seats 81 of the circuit unit 8 are exposed from the open end 51 of the case 5. In this embodiment, the case 5 has opposite lateral sides, each of which is formed with a plurality of vent holes 52 for heat dissipation.

The cover member 6 is mounted detachably on the open end 51 of the case 5. In this embodiment, as best shown in FIG. 4, the cover member 6 has opposite lateral sides, each of which is formed with first and second openings 60, 61. Each lateral side of the cover member 6 has opposite side walls 62, each of which has a pivot edge 621 formed with a pivot groove 63, and a vertical edge 622. The pivot edges 621 of the side walls 62 in each lateral side confine the first opening 60. The vertical edges 622 of the side walls 62 in each lateral side confine the second opening 61. Each lateral side of the cover member 6 further has a bottom wall 65 extending between the side walls 62 and spaced apart from the pivot edges 621 of the side walls 62. Each connecting seat 81 of the circuit unit 8 is spaced apart from the vertical edges 622 of the side walls 62 in a corresponding one of the lateral sides by the bottom wall 65. In each lateral side of the cover member 6, the side walls 62, the bottom wall 65 and a corresponding one of the connecting seats 81 cooperate to confine a block receiving space 64. In this embodiment, each pivot groove 63 has a restricted upper neck portion 631 and a wider lower receiving portion 632, and is formed during molding of the cover member 6.

Each terminal block 9 is mounted detachably in the block receiving space 64 through the second opening 61 in a corresponding one of the lateral sides of the cover member 6 such that each terminal block 9 is accessible through the second opening 61 in the corresponding one of the lateral sides of the cover member 6. Each terminal block 9 has a mounting side 94 provided with a set of second conductive contacts 941 that are connected electrically, respectively and removably to the first conductive contacts 811 in a corresponding one of the connecting seats 81, and an input side 93 opposite to the mounting side 94 and formed with a set of input insertion holes 931 adapted for insertion of a set of external terminals 110 (see FIG. 5) so as to permit connection of the external terminals 110 to the first conductive contacts 811 in the corresponding one of the connecting seats 81 through the second conductive contacts 941, respectively, and a top side 91 formed with a set of probe insertion holes 92 adapted for insertion of a set of test probes 4 (only one is shown in FIG. 5) so as to permit connection of the test probes 4 to the first conductive contacts 811 in the corresponding one of the connecting seats 81 through the second conductive contacts 941, respectively.

The positioning members 100 are mounted pivotally and respectively on the lateral sides of the cover member 6. Each positioning member 100 is disposed at the first opening 60 in a corresponding one of the lateral sides of the cover member 6 for positioning a respective terminal block 9 on the corresponding connecting seat 81. Each positioning member 100 has a first plate body 102 disposed above the top side 91 of the respective terminal block 9 and formed with a set of positioning holes 103 that are registered with the probe insertion holes 92 in the top side 91 of the respective terminal block 9, and a second plate body 104 connected to the first plate body 102, extending into the second opening 61 in the corresponding one of the lateral sides of the cover member 6 and engaging the input side 93 of the corresponding one of the terminal blocks 9 without covering the input insertion holes 931. The first plate body 102 of each positioning member 100 is formed with opposite pivot posts 101 that are pivotally retained in the pivot grooves 63 in the side walls 62 of the corresponding one of the lateral sides of the cover member 6, as shown in FIG. 5. In this embodiment, each pivot post 101 is received in the lower receiving portion 632 of a corresponding one of the pivot grooves 63, and has a size larger than that of the upper neck portion 631 and smaller than that of the lower receiving portion 632.

Figure 6:
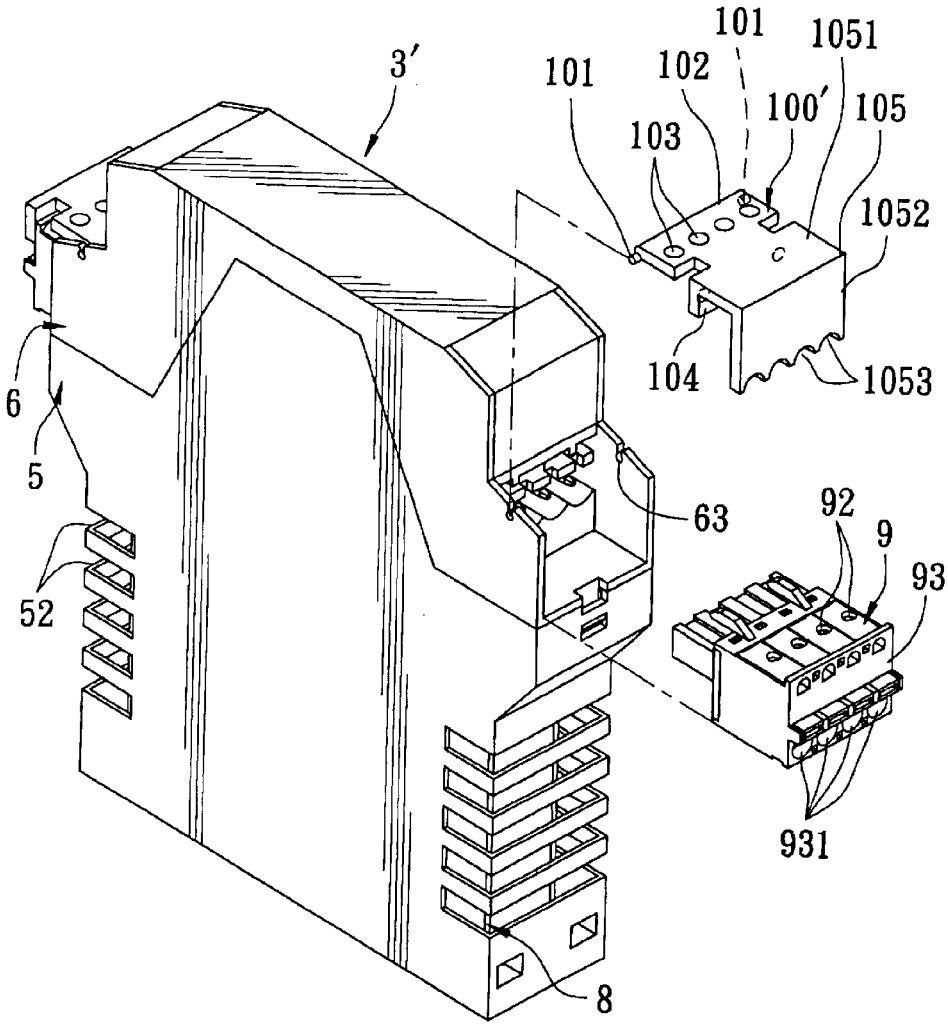
FIG. 6 is a partly exploded perspective view showing the second preferred embodiment of a controller module according to the present invention.
Figure 7:
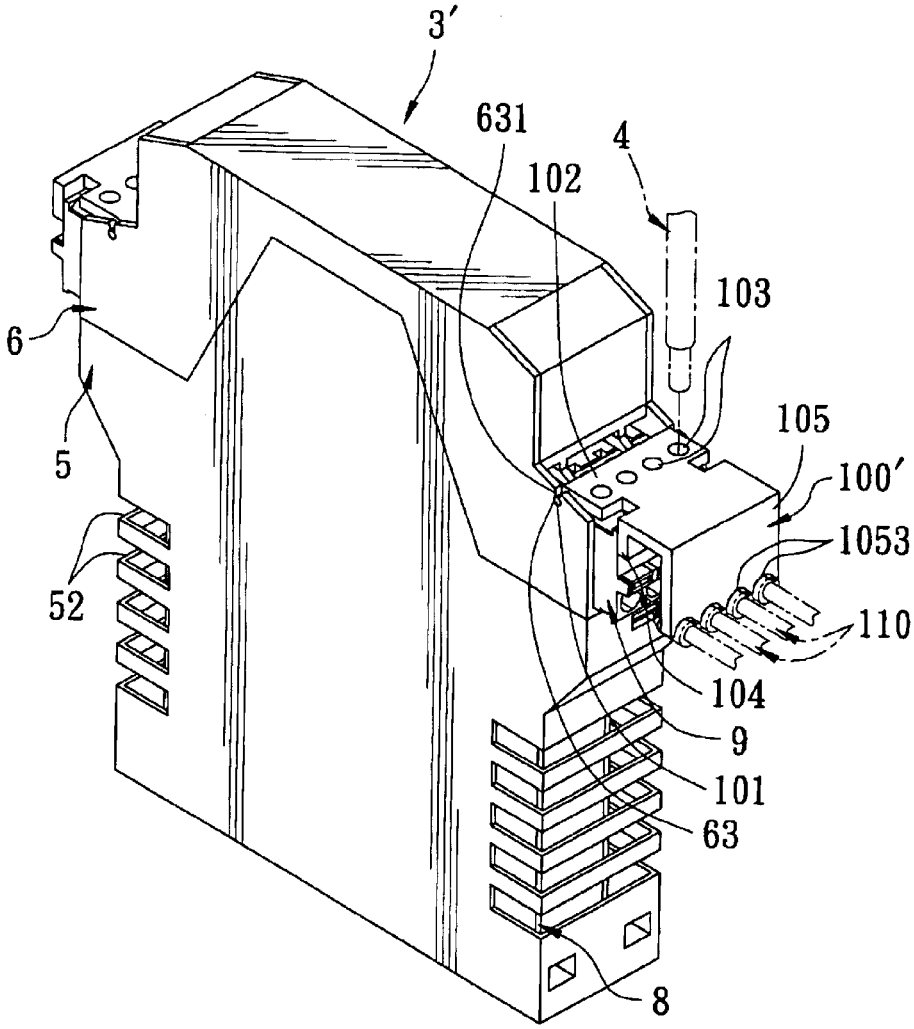
FIG. 7 is an assembled perspective view of the second preferred embodiment.

FIGS. 6 and 7 illustrate the second preferred embodiment of a controller module 3' according to this invention, which is a modification of the first preferred embodiment. Unlike the previous embodiment, each positioning member 100' further has a third plate body 105 with a connecting portion 1051 connected to a junction of the first and second plate bodies 102, 104, and a positioning portion 1052 connected to the connecting portion 1051 and extending parallel to the second plate body 104. The positioning portion 1052 is formed with a set of notches 1053 registered with the input insertion holes 931 in the input side 93 of the corresponding terminal block 9.

To sum up, due to the presence of the positioning holes 103 in the positioning members 100, 100', the test probes 4 can be directly inserted into the probe insertion holes 92 in the terminal blocks 9 through the positioning holes 103, respectively, without pivoting the positioning members 100, 100', thereby resulting in convenience during use. Furthermore, reliable positioning of the test probes 4 can be ensured.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A controller module responsive to input signals for controlling an electrical appliance, said controller module comprising:

a circuit unit including a control circuit adapted to be connected electrically to the electrical appliance, and a connecting seat coupled electrically to said control circuit and formed with a set of first conductive contacts;

a hollow case having an open end, said circuit unit being disposed in said case such that said connecting seat of said circuit unit is exposed from said open end of said case;

a cover member mounted detachably on said open end of said case, said cover member being formed with first and second openings, said cover member having opposite side walls, each of which has a pivot edge formed with a pivot groove, and a vertical edge, said pivot edges of said side walls confining said first opening, said vertical edges of said side walls confining said second opening, said cover member further having a bottom wall extending between said side walls and spaced apart from said pivot edges of said side walls, said connecting seat of said circuit unit being spaced apart from said vertical edges of said side walls by said bottom wall, said side walls, said bottom wall and said connecting seat cooperating to confine a block receiving space;

a terminal block mounted detachably in said block receiving space through said second opening in said cover member such that said terminal block is accessible through said second opening, said terminal block having a mounting side provided with a set of second conductive contacts that are connected electrically, respectively and removably to said first conductive contacts, an input side opposite to said mounting side and formed with a set of input insertion holes adapted for insertion of a set of external terminals so as to permit connection of the external terminals to said first conductive contacts through said second conductive contacts, respectively, and a top side formed with a set of probe insertion holes adapted for insertion of a set of test probes so as to permit connection of the test probes to said first conductive contacts through said second conductive contacts, respectively; and a positioning member mounted pivotally on said cover member and disposed at said first opening in said cover member for positioning said terminal block on said connecting seat, said positioning member having a first plate body disposed above said top side of said terminal block and formed with a set of positioning holes that are registered with said probe insertion holes in said top side of said terminal block, respectively, and a second plate body connected to said first plate body, extending into said second opening in said cover member, and engaging said input side of said terminal block without covering said input insertion holes, said first plate body being formed with opposite pivot posts that are pivotally retained in said pivot grooves, respectively.

2. The controller module as claimed in claim 1, wherein each of said pivot grooves has a restricted upper neck portion and a wider lower receiving portion, each of said pivot posts being received in said lower receiving portion and having a size larger than that of said upper neck portion and smaller than that of said lower receiving portion.

3. The controller module as claimed in claim 1, wherein said positioning member further has a third plate body with a connecting portion connected to a junction of said first and second plate bodies, and a positioning portion connected to said connecting portion and extending parallel to said second plate body, said positioning portion being formed with a set of notches registered with said input insertion holes, respectively.

* * * * *